US012018536B2

(12) United States Patent
Gao et al.

(10) Patent No.: US 12,018,536 B2
(45) Date of Patent: Jun. 25, 2024

(54) CONTINUOUS CONDUIT APPARATUS BASED ON GUIDING AND INJECTING INTEGRATED MECHANISM

(71) Applicant: SHENZHEN UNIVERSITY, Shenzhen (CN)

(72) Inventors: Mingzhong Gao, Shenzhen (CN); Heping Xie, Shenzhen (CN); Mingqing Yang, Shenzhen (CN); Ling Chen, Shenzhen (CN); Le Zhao, Shenzhen (CN); Jianan Li, Shenzhen (CN); Bo Yu, Shenzhen (CN); Cong Li, Shenzhen (CN); Zhiqiang He, Shenzhen (CN); Yunqi Hu, Shenzhen (CN)

(73) Assignee: SHENZHEN UNIVERSITY, Guangdong (CN)

( * ) Notice: Subject to any disclaimer, the term of this patent is extended or adjusted under 35 U.S.C. 154(b) by 0 days.

(21) Appl. No.: 18/010,091

(22) PCT Filed: Dec. 3, 2020

(86) PCT No.: PCT/CN2020/133655
§ 371 (c)(1),
(2) Date: Dec. 13, 2022

(87) PCT Pub. No.: WO2022/021718
PCT Pub. Date: Feb. 3, 2022

(65) Prior Publication Data

US 2023/0349245 A1 Nov. 2, 2023

(30) Foreign Application Priority Data

Jul. 28, 2020 (CN) ..... 202010737010.9

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 3,690,136 A * 9/1972 Slator ..... E21B 19/22 166/77.2
3,841,407 A * 10/1974 Bozeman ..... E21B 19/22 226/173

(Continued)

FOREIGN PATENT DOCUMENTS

CN 202228019 U 5/2012
CN 202370459 U 8/2012

(Continued)

*Primary Examiner* — James G Sayre
(74) *Attorney, Agent, or Firm* — Muncy, Geissler, Olds & Lowe, P.C

(57) ABSTRACT

Disclosed is a continuous conduit apparatus based on guiding and injecting integrated mechanism, which comprises a straightening apparatus and a pair of sprocket and chain clamping assemblies. The pair of sprocket and chain clamping assemblies are configured to clamp the conduit and pull the conduit to go downwards a well or upwards a lifting direction. Between the pair of sprocket and chain clamping assemblies, a conduit guide channel applied for the conduit to passing through is formed. An inlet and an outlet of the conduit guide channel are not situated in a straight line, and the straightening apparatus are configured to straighten the conduit. Each of the two sprocket and chain clamping assemblies comprises a sprocket set, a chain, a plurality of clamping blocks mounted on the chain, and a pushing plate configured to press the clamping blocks.

13 Claims, 5 Drawing Sheets

(56) References Cited

U.S. PATENT DOCUMENTS

| | | | | |
|---|---|---|---|---|
| 5,094,340 | A * | 3/1992 | Avakov | E21B 19/22<br>226/173 |
| 6,209,634 | B1 | 4/2001 | Avakov et al. | |

FOREIGN PATENT DOCUMENTS

| | | | |
|---|---|---|---|
| CN | 203334990 | U | 12/2013 |
| CN | 104100217 | A | 10/2014 |
| CN | 111810072 | A | 10/2020 |
| CN | 111997540 | A | 11/2020 |
| CN | 112012681 | A | 12/2020 |
| CN | 212508155 | U | 2/2021 |
| CN | 212508157 | U | 2/2021 |
| CN | 212535593 | U | 2/2021 |

* cited by examiner

CONTINUOUS CONDUIT APPARATUS BASED ON GUIDING AND INJECTING INTEGRATED MECHANISM

CROSS-REFERENCES TO RELATED APPLICATIONS

This application is a national stage application of PCT Patent Application No. PCT/CN2020/133655, filed on Dec. 3, 2020, which claims priority to Chinese Patent Application No. 202010737010.9, filed on Jul. 28, 2020, the content of all of which is incorporated herein by reference.

FIELD OF THE INVENTION

The present application relates to the technical field of underground exploration, in particular to a continuous conduit apparatus based on guiding and injecting integrated mechanism.

BACKGROUND

Shown as FIG. 1, an existing continuous conduit work equipment typically comprises a guiding gooseneck (100) and an injector head (200), the guiding gooseneck is applied to guiding a continuous conduit to go into the injector head. A plurality of main functions of the injector head comprises:

(1) applying axial force to the continuous conduit to overcome the dead weight of the continuous conduit, as well as the buoyancy and the friction of the continuous conduit, providing sufficient pushing or pulling force to control well exiting or well entering movement of the continuous conduit;

(2) bearing the suspension weight of an entire continuous conduit when the continuous conduit is stationary;

(3) providing sufficient clamping force to prevent a relative sliding between the continuous conduit and a clamping block;

(4) controlling the lifting and lowering speed of the continuous conduit in a plurality of different conditions (5) providing a working platform for weight sensor and encoder;

(6) bearing the dead weight and an additional load of the entire continuous conduit.

In the prior art, an inlet of the injector head of a continuous conduit is locating directly above an outlet, the injector head itself has a certain height, together with a height of the guiding gooseneck, resulting in a height of an overall equipment very high, which is not suitable for a working environment with a limited space height (including a coal mine laneway having a typical height no more than 3 m).

BRIEF SUMMARY OF THE DISCLOSURE

According to the defects in the prior art described above, the present application provides a continuous conduit apparatus based on a guiding and injecting integrated mechanism.

The technical solution of the present application to solve the technical problems is as follows:

a continuous conduit apparatus based on a guiding and injecting integrated mechanism, which comprises a straightening apparatus and a pair of sprocket and chain clamping assemblies, the pair of sprocket and chain clamping assemblies are applied to clamping the conduit and pulling the conduit to go downwards a well or upwards a lifting direction; between the pair of sprocket and chain clamping assemblies, a conduit guide channel applied for the conduit to passing through is formed; an inlet and an outlet of the conduit guide channel are not situated in a straight line; the straightening apparatus are applied for straightening the conduit.

Further, the conduit guide channel is arc-shaped.

Further, each of the two sprocket and chain clamping assemblies comprises a sprocket set, a chain, a plurality of clamping blocks mounted on the chain, and a pushing plate applied to pressing the clamping blocks;

the pushing plate is an arc-shaped plate, both pushing plates of the two sprocket and chain clamping assemblies are concentrically arranged; and the pushing plate of at least one sprocket and chain clamping assembly has a clamping driving device connected, applied to driving the pushing plate to move in a radial direction;

the pushing plates of the two sprocket and chain clamping assemblies are applied to forming the conduit guide channel between a certain number of the clamping blocks of the two sprocket and chain clamping assemblies, and making the certain number of the clamping blocks of the two sprocket and chain clamping assemblies clamp the conduit.

Further, the pushing plate presses the clamping blocks through a bearing roller.

Further, a sprocket set of a sprocket and chain clamping assembly located at a periphery comprises a driving wheel, a tensioning wheel and a driven wheel; and a sprocket set of a sprocket and chain clamping assembly located in an inlier comprises at least a driving wheel and a driven wheel.

Preferably, the clamping driving device is a hydraulic cylinder.

Further, the clamping surface of the clamping block has a certain radian in the guiding direction.

Preferably, an angle between an inlet direction and an outlet direction of the conduit guide channel is an acute angle; and the inlet of the conduit guide channel has an arc-shaped guide short section arranged.

Preferably, the straightening apparatus is a roller straightening apparatus.

Further, the straightening apparatus comprises a bracket, a plurality of first rollers, a second roller, a crank arm and a pressing hydraulic cylinder, the first rollers are at least two first rollers, and the first rollers are arranged in a straight line;

one end of the crank arm is movably connected to the bracket, the second roller is rotatably mounted at an inflection point of the crank arm, an output end of the pressing hydraulic cylinder is connected to another end of the crank arm to form a straightening channel between the first roller and the second roller.

Compared with the prior art, the present application has a plurality of following beneficial effects:

the present application integrates a function of guidance and a function of injection together, being able to omit a gooseneck, being able to reduce a height of a device effectively; especially being suitable for a working environment having a limited space height; and by straightening the continuous conduit through the straightening apparatus, it is guaranteed that the continuous conduit goes vertically down into the well, so as to relieve an underground abrasion effectively.

BRIEF DESCRIPTION OF THE DRAWINGS

The drawings described herein are applied to providing a further understanding of the embodiments of the present application, constituting a part of the present application, instead of a limitation to the embodiments of the present application.

DETAILED DESCRIPTION OF EMBODIMENTS

In order to make the purpose, technical solution and the advantages of the present application clearer and more explicit, further detailed descriptions of the present application are stated herein, referencing to the attached drawings and some embodiments of the present application. It should be understood that the detailed embodiments of the application described here are used to explain the present application only, instead of limiting the present application.

Embodiment I

Figure 1:
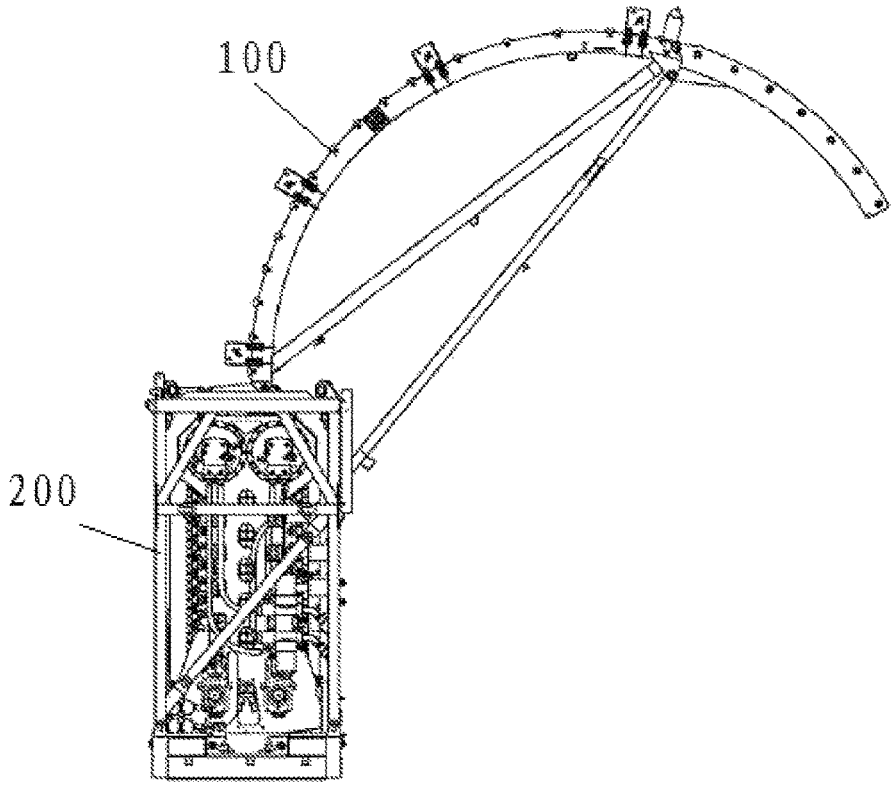
FIG. 1 illustrates a schematic structural diagram on the prior art.
Figure 2:
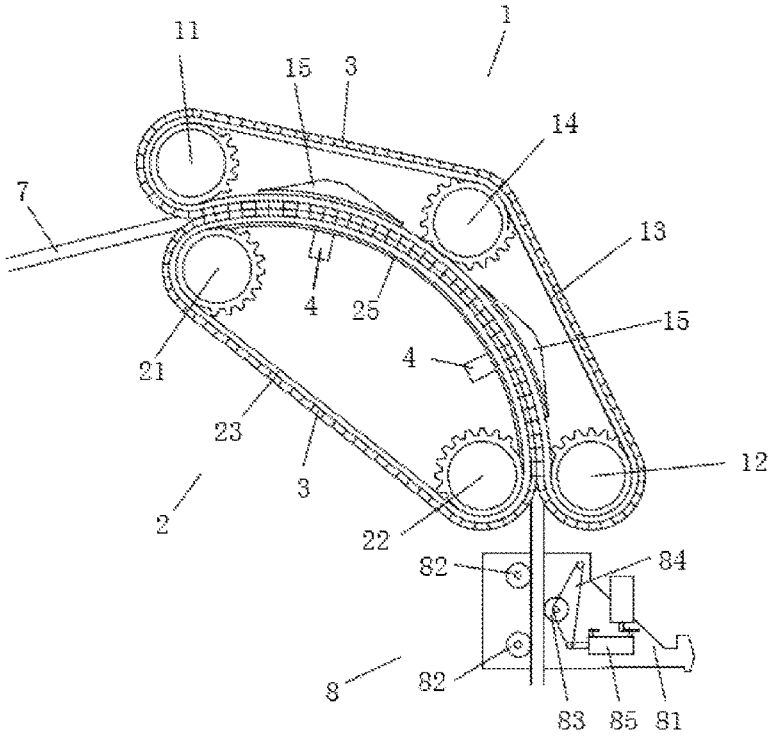
FIG. 2 illustrates a schematic structural diagram on a first embodiment.

Shown as FIG. 2, the present embodiment discloses a continuous conduit apparatus based on a guiding and injecting integrated mechanism, comprising a straightening apparatus 8 and a first sprocket and chain clamping assembly 1 and a second sprocket and chain clamping assembly 2, applied to clamping a conduit 7 and pulling the conduit 7 to go downwards a well or outwards a lifting direction; between the first sprocket and chain clamping assembly 1 and the second sprocket and chain clamping assembly 2, a conduit guide channel for the conduit 7 to pass through is constructed; an inlet and an outlet of the conduit guide channel are not situated in a straight line.

In order to make a deformation of the conduit smoother, the conduit guide channel is arc-shaped.

The first sprocket and chain clamping assembly 1 comprises a first driving wheel 11, a first tensioning wheel 14, a first driven wheel 12, a first chain 13, two first pushing plates 15 and a plurality of clamping blocks 3 arranged on the first chain 13; the first driving wheel 11, the first tensioning wheel 14 and the first driven wheel 12 are not situated in a straight line; the first chain 13 is engaged with the first driving wheel 11, the first tensioning wheel 14 and the first driven wheel 12.

The second sprocket and chain clamping assembly 2 comprises a second driving wheel 21, a second driven wheel 22, a second chain 23, a second pushing plate 25 and a plurality of clamping blocks 3 arranged on the second chain 23; the second chain 23 is engaged with the second driving wheel 21 and the second driven wheel 22.

Both the first pushing plates 15 and the second pushing plate 25 are arc-shaped plates, the first pushing plates 15 and the second pushing plate 25 are arranged concentrically, a radius of the first pushing plates 15 is larger than that of the second pushing plate 25.

Obviously, either of the first driving wheel 11 and the second wheel 21 has a traction motor connected. The first driving wheel 11, the first tensioning wheel 14, the first driven wheel 12, the second driving wheel 21, the second driven wheel 22 and the second chain 23 are all arranged on a rack. Either the traction motor or the rack is shown in the drawings, which is a conventional technique in the art and no more details are stated herein.

The second pushing plate 25 in the present embodiment has a clamping driving device 4 connected, applied to driving the pushing plate to move in a radial direction; the clamping driving device 4 is a hydraulic cylinder.

The first pushing plates 15 and the second pushing plate 25 are applied to constructing a conduit guide channel between a certain number of the clamping blocks 3 on the first chain 13 and a certain number of the clamping blocks 3 on the second chain 23, and making the certain numbers of the clamping blocks 3 on the first chain 13 and the second chain 23 clamp the conduit 7.

Both an inner edge and an outer edge of the first tensioning wheel 14 in the present embodiment are engaged with the first chain 13. There is a first pushing plate 15 arranged between the first driving wheel 11 and the first tensioning wheel 14, as well as a first pushing plate 15 arranged between the first tensioning wheel 14 and the first driven wheel 12.

One end of the second pushing plate 25 starts from the second driving wheel 21, another end of the second pushing plate 25 extends to the second driven wheel 22. Since the second pushing plate 25 has a longer arc, the second pushing plate 25 has at least two clamping driving devices 4 connected, to ensure a sufficient clamping strength.

Figure 3:
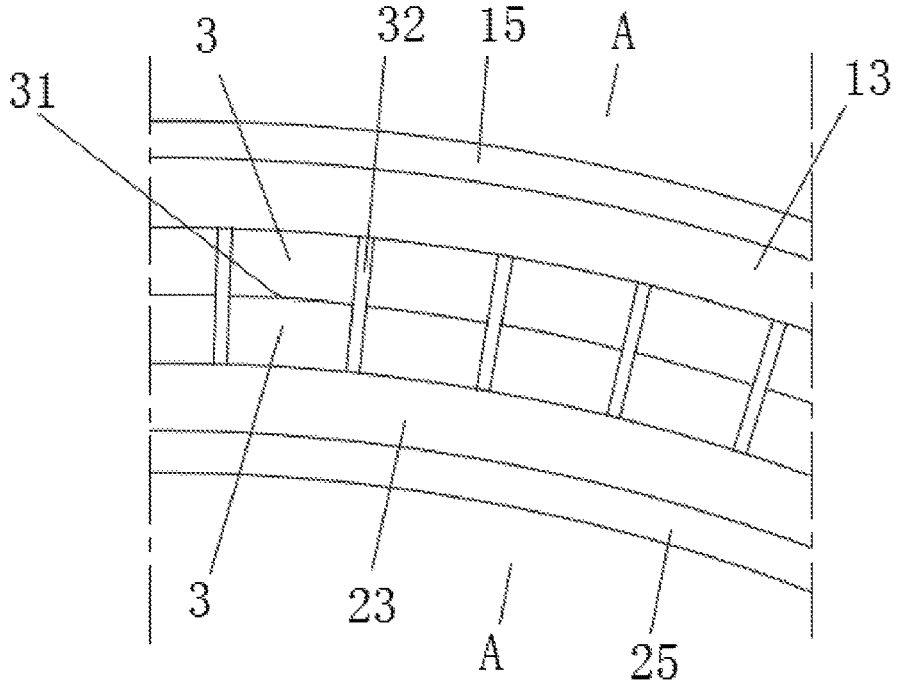
FIG. 3 illustrates a schematic diagram on a local position when a clamping block is clamping a conduit.
Figure 4:
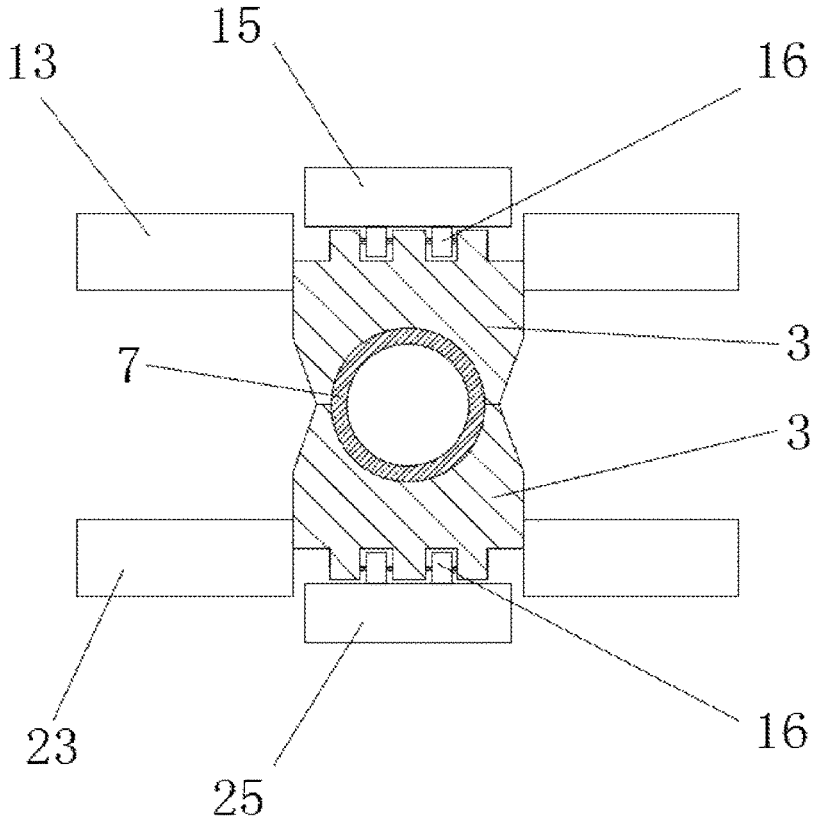
FIG. 4 illustrates a cross-sectional view at A-A of FIG. 3.
Figure 5:
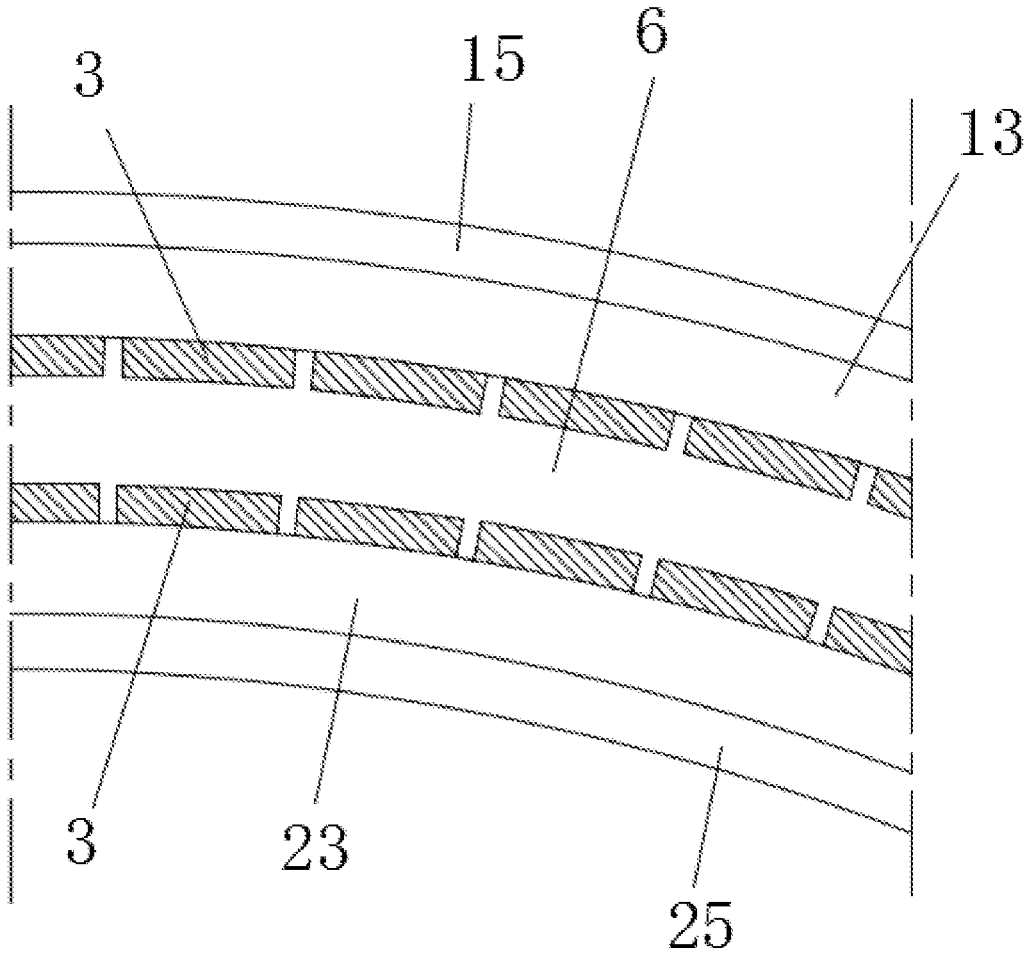
FIG. 5 illustrates a schematic diagram on a local portion of a conduit guide channel.

As shown in FIGS. 3, 4, 5, the clamping blocks 3 are arranged on the chain one block by one block. There is a gap 31 between two adjacent clamping blocks 3. The first pushing plate 15 and the second pushing plate 25 make a plurality of the clamping blocks 3 be arranged along an arc direction, to form a conduit guide channel 6, so as to achieve a guidance for the conduit 7.

A plurality of clamping surfaces of the clamping blocks 3 on the first chain 13 and the second chain 23 have a certain radian at a guiding direction, so as to be in a surface contact with the conduit 7, thereby increasing a clamping force and making a deformation of the conduit 7 smoother.

Shown as FIG. 4, the clamping block 3 has a bearing roller 16 arranged, the first pushing plate 15 presses the bearing roller 16 of the clamping block 3 on the first chain 13, and the second pushing plate 25 presses the bearing roller 16 of the clamping block 3 on the second chain 23.

Obviously, the bearing roller 16 is also able to be mounted on a pushing plate.

The conduit guide channel 6 is arc-shaped, when inserting the conduit, the conduit 7 undergoes a plastic bending deformation at the conduit guide channel 6, thus the conduit 7 coming out of the conduit guide channel 6 has a residual bend, and after going downwards the well, the residual bend causes the conduit 7 to have an easy eccentricity and abrasion with a well wall inside the well, thereby increasing an abrasion in the well.

The present application additionally arranges the straightening apparatus 8 to straighten the conduit 7, so as to eliminate the residual bend of the conduit 7 to a maximum extent, it is guaranteed that the continuous conduit goes vertically downwards the well, being able to relieve the abrasion in the well effectively.

The present embodiment adopts a roller straightening apparatus as the straightening apparatus 8. There are a plurality of roller straightening apparatus, being able to be selected as needed.

The straightening apparatus 8 disclosed by the present application comprises a bracket 81, a plurality of first rollers 82, a second roller 83, a crank arm 84, and a pressing hydraulic cylinder 85, the first rollers 82 are arranged on the bracket 81, the first rollers 82 are at least two, and the first rollers are arranged in a straight line. One end of the crank arm 84 is movably connected to the bracket 81, the second roller 83 is rotatably mounted at an inflection point of the crank arm 84, an output end of the pressing hydraulic cylinder 85 is connected to another end of the crank arm 84, so the second roller 83 is able to press the conduit 7, before forming a straightening channel between the first roller 82 and the second roller 83.

Figure 6:
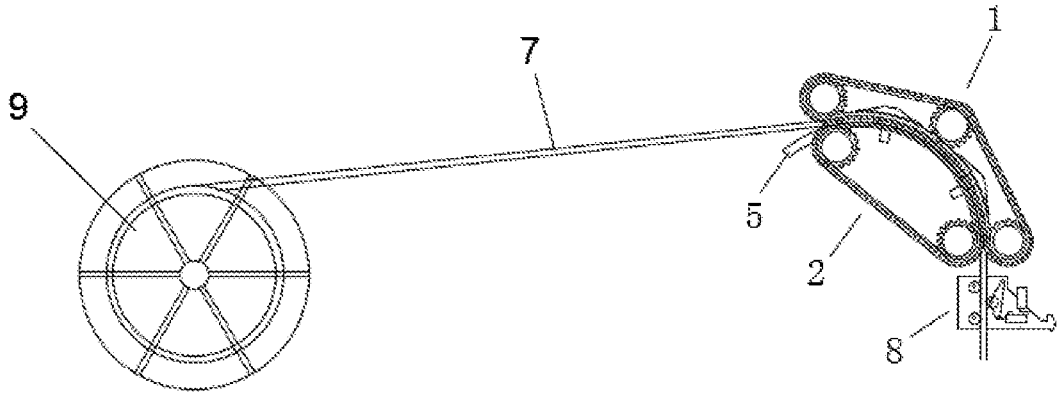
FIG. 6 illustrates a schematic diagram when applying the present application.

A working principle of the present application is as follows:

Shown as FIGS. 2 and 6, the conduit 7 is wound on a drum 9, a free end of the conduit 7 passes through between the clamping blocks 3 on the first chain 13 and the second chain 23;

the first pushing plate 15 and the second pushing plate 25 press the clamping blocks 3 on the first chain 13 and the second chain 23, so that the clamping blocks 3 clamp the conduit 7;

the first driving wheel 11 and the second driving wheel 21 rotate to drive the first chain 13 and the second chain 23 to move, and then drive the clamping block 3 to move, so that the conduit 7 clamped by the clamping blocks 3 moves downwards a well or upwards a lifting direction;

the conduit 7 coming out of the conduit guide channel is straightened by the straightening channel before going vertically down into the well.

Embodiment II

Figure 7:
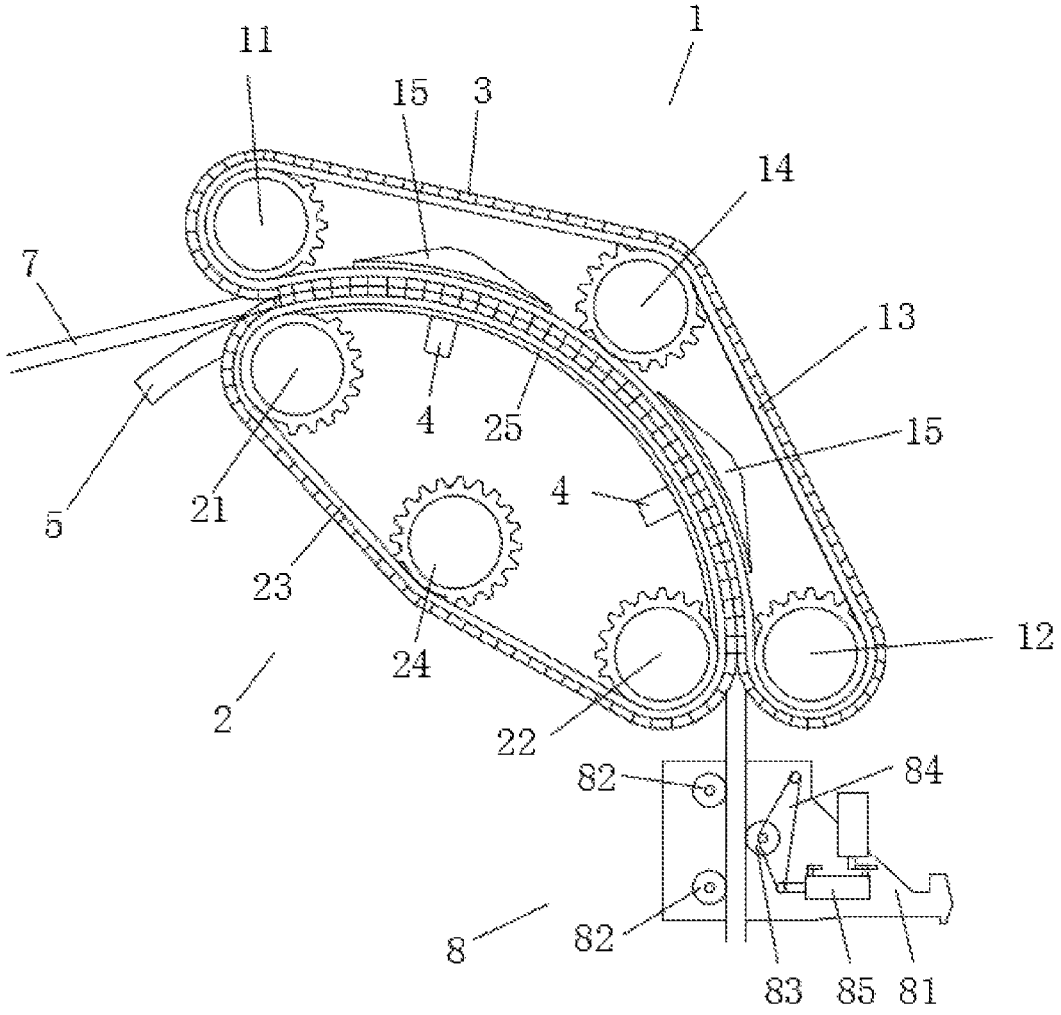
FIG. 7 illustrates a schematic structural diagram on a second embodiment.
Figure 8:
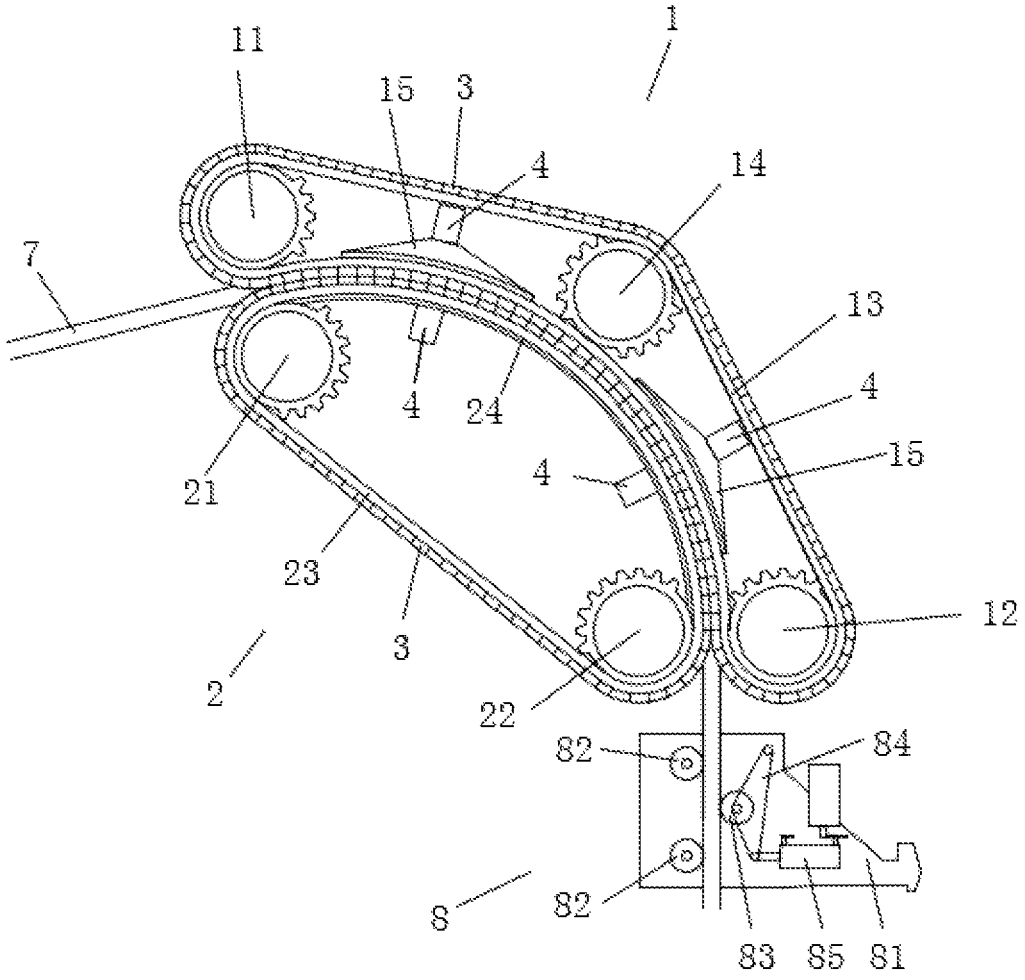
FIG. 8 illustrates a schematic structural diagram on a third embodiment.

The difference between the present embodiment and the embodiment I is: shown as FIG. 7, the second sprocket and chain clamping assembly 2 in the present embodiment further comprises a second tensioning wheel 24 engaged with the second chain 23, while the second driving wheel 21, the second tensioning wheel 24 and the second driven wheel 22 are not in a straight line.

The present embodiment arranges an arc-shaped guide short section 5 at an inlet of the conduit guide channel, while the arc-shaped guide short section 5 is applied to guiding the conduit 7 to enter the conduit guide channel more smoothly. The arc-shaped guide short section 5 is concentric with the conduit guide channel and having a radius equal.

The arc-shaped guide short section 5 locates below the inlet of the conduit guide channel, having a certain supporting action to the conduit 7.

Embodiment III

The difference between the present embodiment and the embodiment I or the embodiment II is: shown as FIG. 7, each of the first pushing plates 15 in the present application has a clamping driving device 4 arranged, applied to driving the first pushing plate 15 to move in a radial direction.

The present application integrates a function of guidance and a function of injection together, as well as adding a straightening apparatus, being able to reduce a height of a device effectively, while ensuring no more abrasion in the well. The present application is especially suitable for a working environment having a limited space height, such as working in a mineral hallway.

It should be understood that, the application of the present application is not limited to the above examples listed. Ordinary technical personnel in this field can improve or change the applications according to the above descriptions, all of these improvements and transforms should belong to the scope of protection in the appended claims of the present application.

What is claimed is:

1. A continuous conduit apparatus based on a guiding and injecting integrated mechanism, comprising a straightening apparatus and a pair of sprocket and chain clamping assemblies, the pair of sprocket and chain clamping assemblies are configured to clamp the conduit and pull the conduit to go downwards in a well or upwards in a lifting direction; between the pair of sprocket and chain clamping assemblies, a conduit guide channel applied for the conduit to passing through is formed; an inlet and an outlet of the conduit guide channel are not situated in a straight line, wherein the straightening apparatus comprises a bracket, a plurality of first rollers, a second roller, a crank arm and a pressing hydraulic cylinder, the plurality of first rollers and the second roller respectively deposited at two sides of the conduit, the first rollers are at least two first rollers, and the first rollers are arranged in a straight line, wherein one end of the crank arm is movably connected to the bracket, the second roller is rotatably mounted at an inflection point of the crank arm, an output end of the pressing hydraulic cylinder is connected to another end of the crank arm, and wherein the second roller is movable to the first rollers to press the conduit and to form a straightening channel between the plurality of first rollers and the second roller.

2. The continuous conduit apparatus based on a guiding and injecting integrated mechanism according to claim 1, wherein the conduit guide channel is arc-shaped.

3. The continuous conduit apparatus based on a guiding and injecting integrated mechanism according to claim 2, wherein each of the two sprocket and chain clamping assemblies comprises a sprocket set, a chain, a plurality of clamping blocks mounted on the chain, and a pushing plate configured to press the clamping blocks;

the pushing plate is an arc-shaped plate, both pushing plates of the two sprocket and chain clamping assemblies are concentrically arranged; and the pushing plate of at least one sprocket and chain clamping assembly has a clamping driving device connected, the clamping driving device is configured to drive the pushing plate to move in a radial direction;

the pushing plates of the two sprocket and chain clamping assemblies are configured to form the conduit guide channel between a certain number of the clamping blocks of the two sprocket and chain clamping assemblies, and make the certain number of the clamping blocks of the two sprocket and chain clamping assemblies clamp the conduit.

4. The continuous conduit apparatus based on a guiding and injecting integrated mechanism according to claim 2, wherein an angle between an inlet direction and an outlet direction of the conduit guide channel is an acute angle; and the inlet of the conduit guide channel has an arc-shaped guide short section arranged.

5. The continuous conduit apparatus based on a guiding and injecting integrated mechanism according to claim 1, wherein each of the two sprocket and chain clamping assemblies comprises a sprocket set, a chain, a plurality of clamping blocks mounted on the chain, and a pushing plate configured to press the clamping blocks;

the pushing plate is an arc-shaped plate, both pushing plates of the two sprocket and chain clamping assemblies are concentrically arranged; and the pushing plate of at least one sprocket and chain clamping assembly has a clamping driving device connected, the clamping driving device is configured to drive the pushing plate to move in a radial direction;

the pushing plates of the two sprocket and chain clamping assemblies are configured to form the conduit guide channel between a certain number of the clamping blocks of the two sprocket and chain clamping assemblies, and make the certain number of the clamping blocks of the two sprocket and chain clamping assemblies clamp the conduit.

6. The continuous conduit apparatus based on a guiding and injecting integrated mechanism according to claim 3, wherein the pushing plate presses the clamping blocks through a bearing roller.

7. The continuous conduit apparatus based on a guiding and injecting integrated mechanism according to claim 3, wherein a sprocket set of a sprocket and chain clamping assembly located at a periphery comprises a driving wheel, a tensioning wheel, and a driven wheel; and a sprocket set of a sprocket and chain clamping assembly located in an inlier comprises at least a driving wheel and a driven wheel.

8. The continuous conduit apparatus based on a guiding and injecting integrated mechanism according to claim 3, wherein the clamping driving device is a hydraulic cylinder.

9. The continuous conduit apparatus based on a guiding and injecting integrated mechanism according to claim 3, wherein a clamping surface of the clamping block has a certain radian at a guiding direction.

10. The continuous conduit apparatus based on a guiding and injecting integrated mechanism according to claim 9, wherein an angle between an inlet direction and an outlet direction of the conduit guide channel is an acute angle; and the inlet of the conduit guide channel has an arc-shaped guide short section arranged.

11. The continuous conduit apparatus based on a guiding and injecting integrated mechanism according to claim 1, wherein an angle between an inlet direction and an outlet direction of the conduit guide channel is an acute angle; and the inlet of the conduit guide channel has an arc-shaped guide short section arranged.

12. The continuous conduit apparatus based on a guiding and injecting integrated mechanism according to claim 1, wherein the straightening apparatus is a roller straightening apparatus.

13. A continuous conduit apparatus based on a guiding and injecting integrated mechanism, comprising a straightening apparatus and a pair of sprocket and chain clamping assemblies, the pair of sprocket and chain clamping assemblies are configured to clamp the conduit and pull the conduit to go downwards in a well or upwards in a lifting direction; between the pair of sprocket and chain clamping assemblies, a conduit guide channel applied for the conduit to passing through is formed; an inlet and an outlet of the conduit guide channel are not situated in a straight line, wherein a sprocket set of one of the pair of sprocket and chain clamping assemblies located at a periphery comprises a driving wheel, a tensioning wheel, and a driven wheel; and a sprocket set of another of the pair of sprocket and chain clamping assemblies located in an inlier comprises at least a driving wheel and a driven wheel, wherein the straightening apparatus is configured to straighten the conduit.

* * * * *